United States Patent [19]

Moore

[11] Patent Number: 4,687,005

[45] Date of Patent: Aug. 18, 1987

[54] PIPE BOWL FILTER

[76] Inventor: Harry C. Moore, 1743-F Pinetree N., Columbus, Ohio 43229

[21] Appl. No.: 785,225

[22] Filed: Nov. 7, 1985

[51] Int. Cl.[4] ..... A24F 3/02; A24F 5/08

[52] U.S. Cl. ..... 131/202; 131/203; 131/205; 131/329

[58] Field of Search ..... 131/331, 201, 202, 329, 131/203, 205

[56] References Cited

U.S. PATENT DOCUMENTS 1,987,407 1/1935 McAllaster ..... 131/203

2,308,758 1/1943 Jacob ..... 131/202

2,378,400 6/1945 Gans ..... 131/202

2,762,375 9/1956 Fessler ..... 131/202

*Primary Examiner*—V. Millin

[57] ABSTRACT

A tobacco pipe is provided having a bowl, stem and filter. The filter is inserted into the bowl. The filter is substantially cylindrical in shape having a perforated foil cap located on top of the filter. Associated with the filter is a pull wire so that the filter can be retrieved by the user. The filter removes condensed liquids containing tar and nicotine and also filters the smoke.

1 Claim, 3 Drawing Figures

PIPE BOWL FILTER

FIELD OF THE INVENTION

This invention relates to tobacco pipes and relates more specifically to pipe bowls having retrievable filters located therein.

BACKGROUND OF THE INVENTION

The oldest device for smoking tobacco is the pipe. Basically, the pipe consists of a bowl that holds the burning tobacco, a stem, and a mouthpiece. Because the air in the bowl is heated by the burning tobacco, there is a tendency for the heated air to pick up moisture and tar from the tobacco. This gaseous mixture then condenses into a liquid in the pipe stem and mouthpiece. Unfortunately, this mixture can gradually find its way into the smoker's mouth leaving a bitter aftertaste. Moreover, there is reason to believe that the tar filled liquids may be carcinogenic. Thus, it is desirable to remove these liquids and also filter the smoke for simple health reasons.

SUMMARY OF THE INVENTION

In accordance with this invention, a pipe bowl is provided with a filter with a perforated foil cap on top. The filter is inserted in the bowl. The filter has a pull wire extending throughout the entire length of the filter. The wire extends through the bottom of the filter and is secured to the bottom of the filter by a wire plate. At the top portion of the filter, the pull wire extends to the top of the bowl so that the filter can be retrieved by the user.

DESCRIPTION OF THE DRAWING FIGURES

DESCRIPTION OF THE ILLUSTRATING EMBODIMENTS

Figure 1:
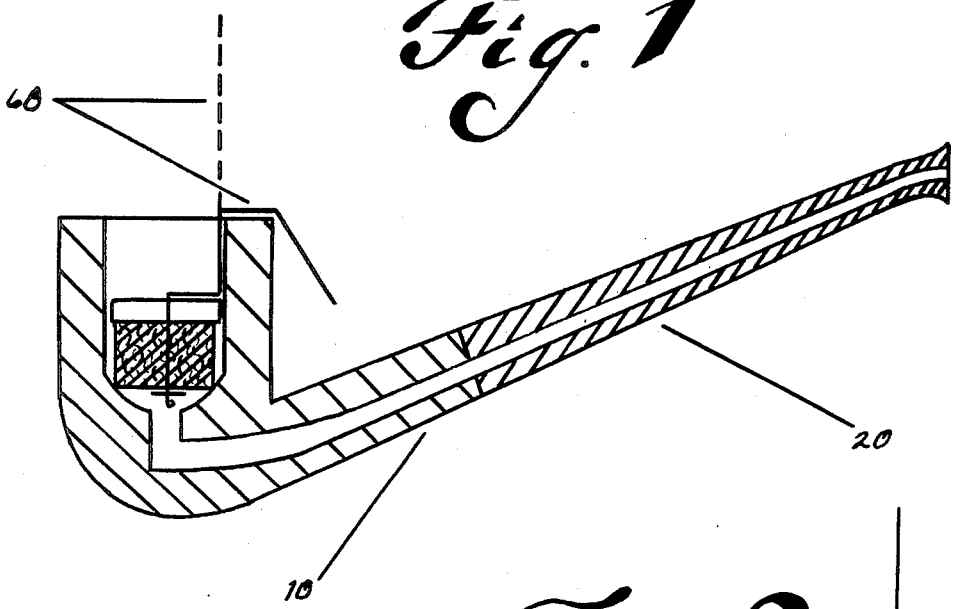
FIG. 1 is a cut away view of a pipe embodying this invention.

FIG. 1 illustrates a pipe 10 having a stem, a mouthpiece 20 and a pull wire 60. The dotted lines of member 60 illustrate the pull wire in a straight up and down position as opposed to its other position where it is secured to the top of the pipe bowl.

Figure 2:
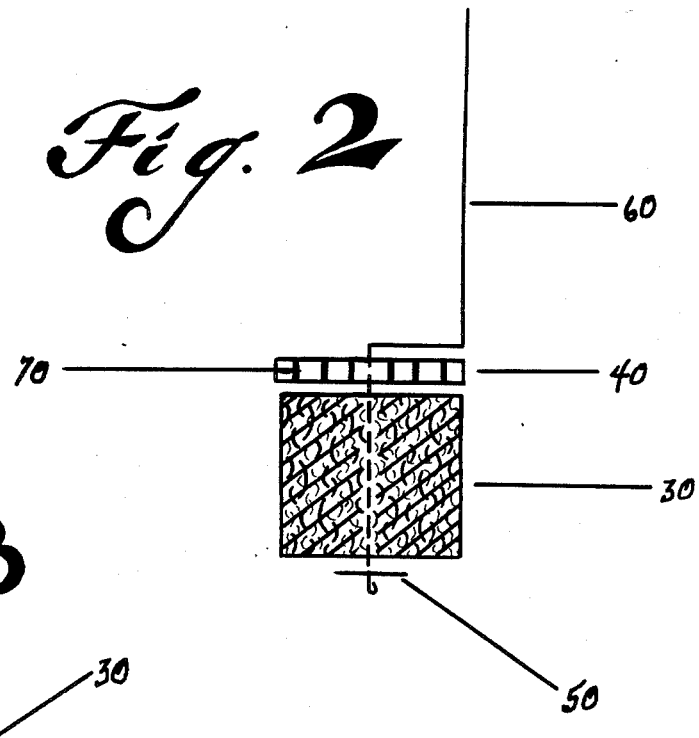
FIG. 2 is a cut away view of the filter with its associated pull wire, perforated cap and a wire plate at the bottom of the filter.

FIG. 2 illustrates the filter shown in FIG. 1. Filter 30 has a perforated cap 40, with associated perforations 70, located on the top of filter 30. Extending through the filter is pull wire 60. Pull wire 60 is secured to the bottom of the filter by wire plate 50.

Figure 3:
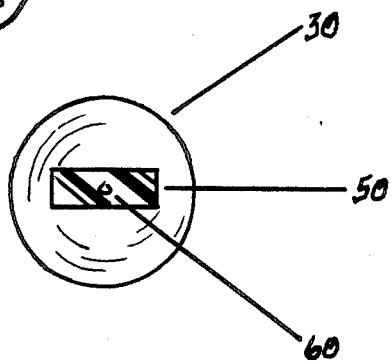
FIG. 3 is a bottom view of the filter of FIG. 2.

FIG. 3 is a bottom view of FIG. 2 illustrating the bottom of filter 30 with wire plate 50 securing pull wire 60 to the bottom of the filter.

Having thus described this invention, what is claimed:

1. A tobacco pipe comprising a bowl, stem, mouthpiece, and a filter inserted in said bowl so that any tobacco inserted into said bowl to be smoked would be in substantially direct contact with said filter; said filter being substantially cylindrical in shape and having a perforated foil cap on top of said filter; said filter having a pull wire extending throughout the entire length of said filter; said wire extending (a) through the bottom of said filter being secured at said bottom by a wire plate and (b) through the top of the filter; said extension through the top having length so that it can extend beyond the top of the bowl so that said filter can be retrieved by the user.

* * * * *